US005570849A

United States Patent [19]

Anderson

[11] Patent Number: 5,570,849

[45] Date of Patent: Nov. 5, 1996

[54] TUB GRINDER

[76] Inventor: Robert R. Anderson, 29774 Hwy. 257, Windsor, Colo. 80550

[21] Appl. No.: 426,086

[22] Filed: Apr. 21, 1995

[51] Int. Cl.[6] ..... B02C 13/286

[52] U.S. Cl. ..... 241/186.4; 241/101.761

[58] Field of Search ..... 241/186.4, 189.1, 241/286

[56] References Cited

U.S. PATENT DOCUMENTS

| | | | |
|---|---|---|---|
| 1,274,126 | 7/1918 | Williams | 241/286 |
| 4,033,515 | 7/1977 | Barcell et al. | 241/189.1 |
| 4,485,976 | 12/1984 | White | 241/186.4 |
| 4,773,601 | 9/1988 | Urich et al. | 241/189.1 |

*Primary Examiner*—Mark Rosenbaum
*Assistant Examiner*—Adrian L. Coley
*Attorney, Agent, or Firm*—Dean P. Edmundson

[57] ABSTRACT

A tub grinder which includes a comb on the floor adjacent the opening. The comb is movable toward and away from the rotor to adjust the size of the opening and to regulate the rate at which bulk material is impacted by the rotor. The comb also assists in preventing wads or slugs of the material from getting to the rotor. The tub grinder can also include notched bars below the floor for holding strings and fibrous material so that the hammers can cut them into shorter lengths. An air deflector can also be included to direct air flow from the rotor back toward the rotor. An adjustable restricter can also be included adjacent the rotor.

12 Claims, 3 Drawing Sheets

TUB GRINDER

FIELD OF THE INVENTION

This invention relates to material processors or grinders of the type which are used to grind bulk materials or reduce the particle size of bulk materials. More particularly, this invention relates to tub grinders which are used to grind bulk materials and reduce the particle size of the material.

BACKGROUND OF THE INVENTION

Material processors-for reducing the particle size of bulk materials have been used for centuries in one form or another. One type of material processor of more recent use is known as a tub grinder. This type of apparatus includes a large tub having an open top for receiving bulk material to be processed. A stationary floor in the tub is in a generally horizontal plane.

A rotor member is mounted under the floor, and hammers or blades on the rotor extend into the tub through an opening in the stationary floor. The rotor is rotated at a high rate of speed, and the tub is rotated slowly. The hammers or blades on the rotor strike the bulk material and grind it into smaller particles. A screen having small apertures in it may be positioned in close proximity to the rotor under the floor. The bulk material cannot pass through the screen until the particles are smaller than the apertures.

As the tub is rotated the bulk material is continually urged against the revolving rotor member. The processed bulk material either falls through the screen system and is carried out by conveying or it is carried around the rotor by the hammers and thrown out the back side of the rotor and back into the tub where it is pushed around again by the rotating tub. Then the process is repeated.

Because the bulk material particles are typically forced through a screen in a conventional tub grinder, the speed of processing the bulk material is limited, and significant horsepower is required to operate the grinder. Bulk material stored outside tends to become wet and tough due to inclement weather. When putting such types of bulk material in the conventional tub grinder, the screen plugs up easily, thereby making grinding very difficult or impossible. Also, different screens must be used to obtain different particle size processed material. Another disadvantage of conventional tub grinders is that they tend to blow material out of the top of the tub when only a small amount of material is in the tub.

A conventional tub grinder is described, for example, in U.S. Pat. No. 4,106,706 (Burrows) which is referred to as a "cut-and-throw" machine where the rotating hammers move the bulk material down through the opening in the floor, past shear plates where the material is ground, and then the material is propelled at high speed out through an exit spout. The rapidly rotating hammermill generates an air stream which is intended to push the particles upwardly through the discharge chute.

The discharge chute or spout can easily become plugged when the bulk material is wet or is of the type which becomes easily compacted after being ground. Then the grinding operation must be stopped in order to manually clean out the discharge chute. This can be a very cumbersome and time-consuming task.

Also, the conventional tub grinder tends to cause undesirable separation of the ground material as it is blown or thrown out of the discharge chute. Not only does this result in the formation of a considerable amount of dust, it can also result in a very non-uniform distribution of the particles in the feed produced. Further, the conventional tub grinder of the type described above does not have the capability to allow a screen to be included adjacent the rotating hammers for the purpose of causing the particles to be reduced to even smaller size before they exit the machine.

European Patent Application No. 0121751 describes a tub machine having a rotor in the floor. The rotor includes knives which cut through bulk material such as hay or straw. The machine does not appear to be capable of handling material such as wood pallets or other material which is difficult to grind. The cut material falls downwardly to an auger for conveying the material to a blower for lifting and blowing the material out through a discharge chute. Thus, the apparatus can exhibit the same problems as exhibited by the Burrows machine described above.

Another conventional tub grinder is described in U.S. Pat. No. 4,003,502 (Barcell). This grinder has positionable blades on the sidewalls. The blades are rigid and are securely held in one position. Bolts extend through the blades and through the rib of the side wall to prevent movement of the blades while operating the grinder. The position of the blades is adjustable only by removing bolts when the grinder is at rest.

U.S. Pat. No. 4,087,051 (Moeller) also describes a tub grinder of the cut-and-throw type. S.U. 650,554 also describes a conventional tub grinder which has been modified to include an auger above the floor to carry the bulk material toward the center of the hopper to load the hammers evenly. Germany Patent 627,320 appears to describe a hammermill where the hammers are tilted away from vertical.

Another disadvantage of conventional tub grinders is that they tend to throw material upwardly out of the tub when the tub is nearly empty. This can be potentially dangerous when the material thrown out of the tub is a chunk of metal, rock, or other hard object.

Yet another problem with conventional tub grinders is that the rotating hammers sometimes pull large wads or slugs of bulk material from the tub area into the rotor area below the floor. When a wad or slug is pulled into the rotor this tends to slow the speed of the rotor and can result in nonuniform grinding of the material, thereby reducing the efficiency of the machine and increasing wear.

My prior U.S. Pat. No. 5,207,391 describes an improved tub grinder which overcomes many of the problems noted above.

SUMMARY OF THE PRESENT INVENTION

In accordance with the present invention there is provided improved tub grinding apparatus for grinding bulk materials which exhibits significant advantages over previous tub grinders.

The apparatus of the present invention includes a number of features which improve the grinding capabilities of a tub grinder. One such feature involves deflector means for directing air flow from the spinning rotor back toward the rotor. This reduces or prevents the material in the grinder from being thrown upwardly out of the tub.

Another feature of the improved apparatus is an adjustable comb means adjacent the rotor, and in alignment with the rotor, which controls the amount of bulk material which is exposed to the rotating rotor at any one time. By moving the comb means further away from the rotor, more of the bulk material becomes exposed to the hammers on the rotor. Thus, when the bulk material to be processed is wet or tough, the comb means is moved closer to the rotor so that the bulk material exposed to the hammers on the rotor at a given point in time is less than would be the case for dry bulk material. The comb means thus prevents wads or slugs of bulk material from being fed to the rotor. As a result, the comb means increases the efficiency of grinding, increases the uniformity of the ground material, and it also enables the machine to run more smoothly (to reduce wear and to reduce the required horsepower to drive the machine).

Another feature of the apparatus of this invention is retention means beneath the floor of the tub adjacent to the rotor. The retention means includes a plurality of plate members which include notches or slots along the edge which faces the rotor. The retention means serves to catch the bulk material (or portions of it) after it is torn or cut by the hammers on the rotor. By slowing the travel of the bulk material downwardly, and by providing ledges for the bulk material to be caught on, the hammers on the rotor are able to continue cutting the bulk material to further reduce its particle size. The retention means also catches the twine or strings which are used on bales of bulk material and holds the strings so that the hammers on the rotor are able to cut them into short lengths in an efficient manner. Various configurations of retention means are possible.

Below the retention means there is a curved restricter means which curves around the periphery of the rotor and may be moved closer to or further away from the rotor. The restricter means includes a plurality of horizontally disposed (and vertically spaced) bar members whose ends are held in curved raceways. The length of the bar members is generally equal to the length of the rotor. Preferably the raceways are slightly wider than the bar members so that the bar members can move slightly (and independently) while still being prevented from escaping from the raceways. The ability of the bar members to move (e..g, by rotating back and forth a few degrees relative to their longitudinal axis) is advantageous in preventing bulk material from building up in the grooves or gaps between the bar members. If the gaps between the bar members become filled, then the bulk material could pass downwardly without restriction and it would not be sufficiently impacted by the hammers to create the desired particle size. The restricter means impedes the flow of bulk material and assists in causing the bulk material to become reduced in particle size.

Another feature which can be included in the apparatus of this invention is a vertically adjustable support member in the central portion of the floor of the apparatus. By raising the support member, the bulk material is moved upwardly so that less material is being impacted by the hammer on the rotor. By lowering the support member, more bulk material is impacted by the hammers. Thus, the support member acts as a shear length adjustment member for controlling the length of cut of the bulk material.

Other advantages and features of the apparatus of the invention will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
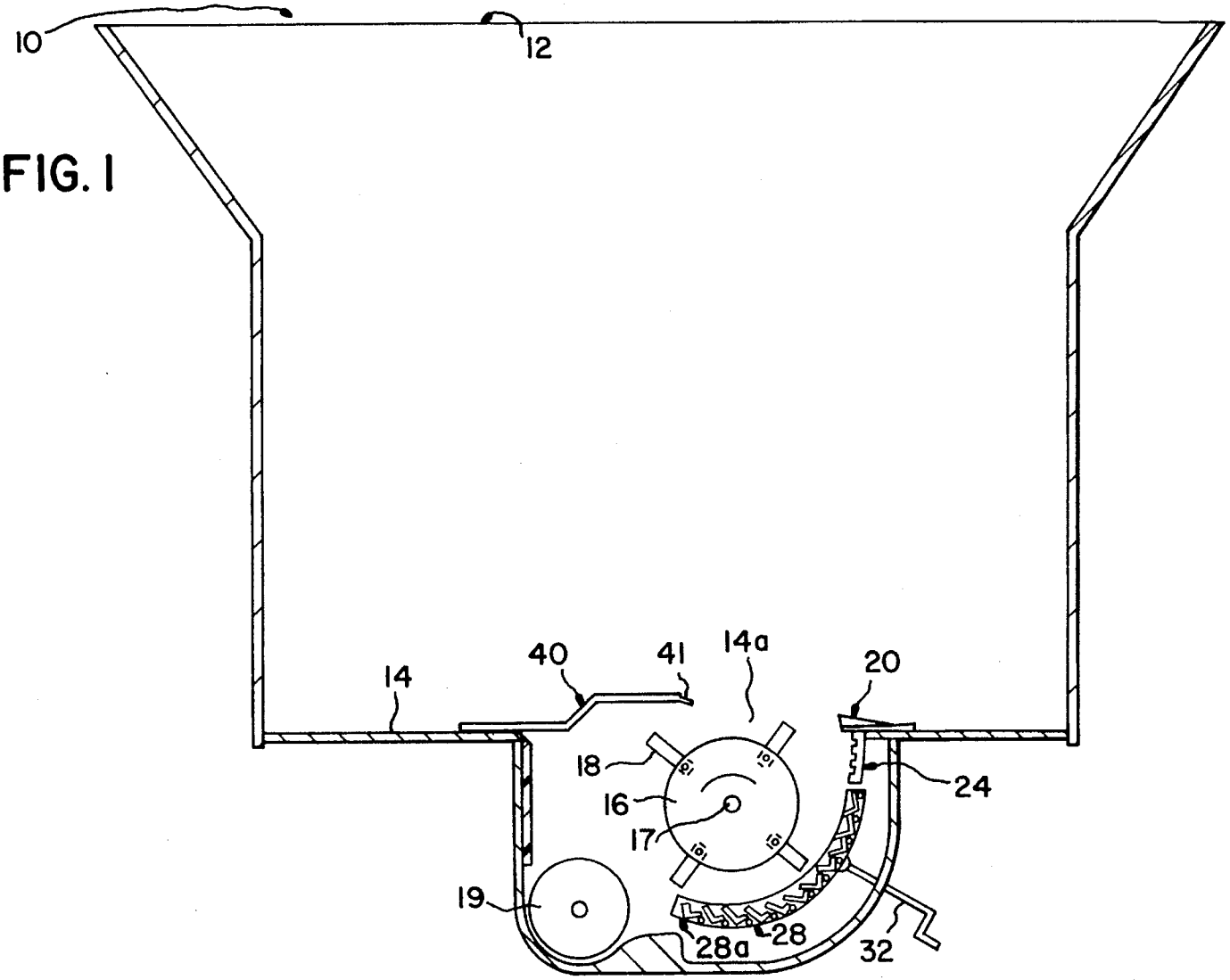
FIG. 1 is a cross-sectional view of one embodiment of tub grinder apparatus of the invention.
Figure 2:
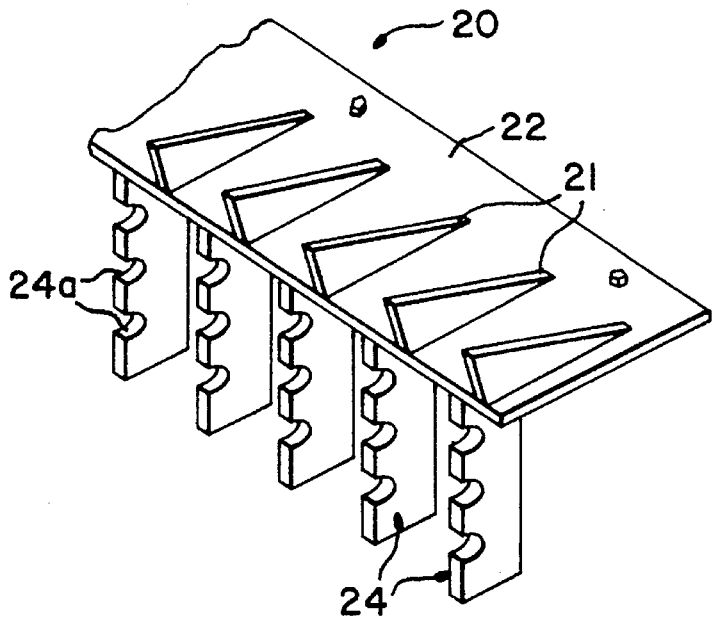
FIG. 2 is a perspective view of the comb means and retention means.

In the drawings there is shown an improved tub grinder 10 of the invention comprising a tub 12 having an open top and a floor member 14 with an opening 14A in the floor. A rotatably driven rotor 16 rotates at high speed about an axis 17. A plurality of hammers 18 are secured to the periphery of the rotor for cutting or grinding bulk material which is placed into the tub. The floor is stationary and the tub is rotated slowly to continually feed the bulk material to the opening in the floor where the hammers extend through the opening. An auger 19 is used to convey away the ground material.

One of the features of the invention is the inclusion of comb means 20 on the floor adjacent to the opening. The comb means includes a plurality of spaced-apart teeth members 21 secured to a flat plate 22 which is bolted to the floor and which can be moved horizontally toward, or away from, the opening and the rotor. Preferably the teeth are spaced apart by a distance of about 2 to 6 inches and are parallel to each other and perpendicular to the axis of the rotor. Preferably the teeth are sloped upwardly from their rearward end to their forward end (adjacent the opening in the floor).

The teeth members of the comb means serve to prevent wads or slugs of the bulk material from entering the rotor area. Although it is preferable for the teeth members to be triangular in shape (as shown in the drawings), it is not necessary to have that shape.

Preferably the height of the teeth members closest to the rotor is in the range of about 2 to 4 inches. The length of the teeth members is preferably about 8 to 10 inches.

Below the floor there preferably is a plurality of vertical bars 24 which include notches 24A on the edge which is facing the rotor. The height of bars 24 is preferably in the range of about 4 to 6 inches, and the spacing between adjacent bars is preferably about 2 to 4 inches.

The notches in the bars 24 serve as ledges to hold the strings of bales of bulk material and also to hold long fibers of the bulk material so that the hammers on the rotor can cut the material into shorter lengths. In this manner the vertical notched bars act as retention means to retain strings and long fibrous material so that the hammers can cut the material into short lengths.

If desired the upper ends of the vertical bars 24 can be secured to the underside of the plate 22. However, the bars 24 can also be secured to a plate which is independent of plate 22. Preferably the notched edges of bars 24 are positioned very close to the path of the outer ends of the hammers on the rotating rotor. Consequently, the bars may be slightly curved to conform to the path of the hammers on the rotor.

Figure 3:
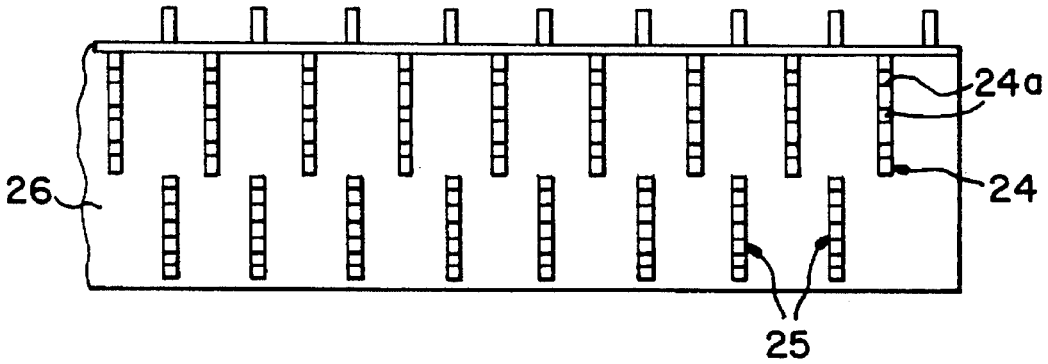
FIG. 3 is a front elevational view of another embodiment of comb means and retention means.
Figure 4:
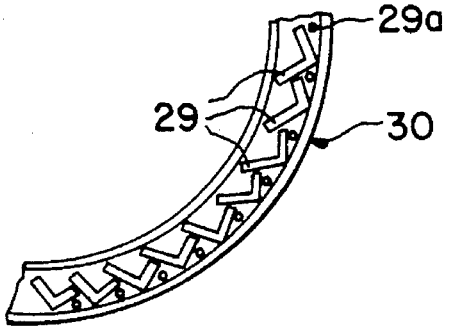
FIG. 4 is an end elevational view of one embodiment of restricter means which is useful in the apparatus of this invention.

In FIG. 3 there is shown another embodiment of retention means wherein there is a second row of vertical bars 25 below the upper row of vertical bars 24. Preferably the lower row of vertical bars 25 is horizontally offset from the upper row of vertical bars, as shown. Bars 25 are also notched in the same manner as bars 24. Bars 24 and 25 are shown attached to plate 26.

Below the retention means there is a restricter means 28 which comprises a plurality of horizontally disposed bar members 29. Each end of the bars is supported in a curved track or raceway 30. Preferably each bar member 29 is an angle iron and has a small stop 29A secured to a rear face at each end to prevent the angle iron from tilting rearwardly too far. Preferably the gap or width of each raceway 30 is slightly greater than the cross-sectional width of the bar members so that the bar members can move back and forth slightly in an angular manner (e.g., about 10°) relative to the longitudinal axis of the bar member. The ability of the bar members to move angularly back and forth tends to prevent the bulk material from building up in the gaps between the bar members. The spacing between the front edges of the bar members facing the rotor is preferably about 2 to 4 inches.

Preferably the lower end 28A of each raceway is hingedly mounted so that the restricter means can be pivoted toward or away from the rotor. For this purpose, a threaded shaft and crank 32 can be used to cause the restricter means to pivot, as desired. Preferably the restricter means curves through an arc of about 60° to 90°.

Figure 5:
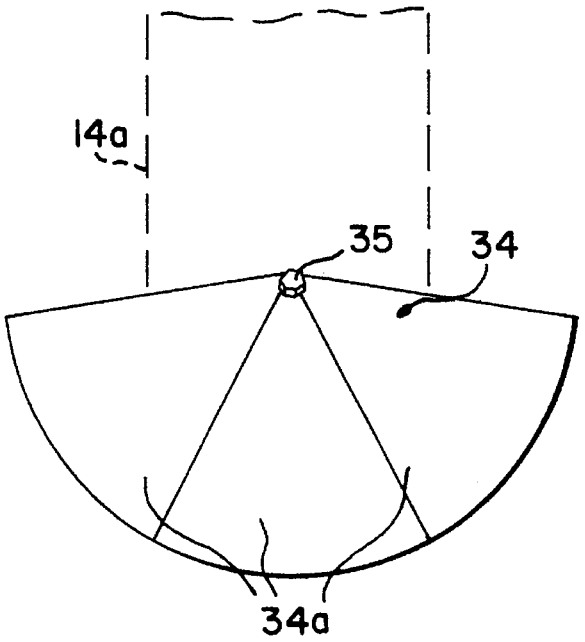
FIG. 5 is a perspective view of one embodiment of support member which is useful in this invention as a shear length adjustment member.

Another feature which can be included in the apparatus is a vertically adjustable support 34 or shear length adjustment means which can be raised or lowered to control the amount of bulk material fed to the rotor at any given time. One embodiment of adjustable support is illustrated in FIG. 5 and comprises a semi-conical member in the center of the floor adjacent the opening. By rotating bolt 35, the cone support member can be raised or lowered. The cone support can comprise several overlapping sections 34A of sheet metal, for example.

Figure 6:
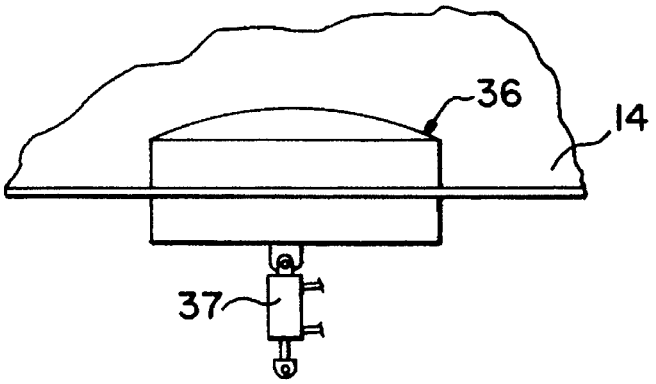
FIG. 6 is a perspective view of another embodiment of support member which is useful in this invention.

Another embodiment of vertically adjustable support 36 is shown in FIG. 6 and comprises a semi-cylindrical member which extends through an appropriately shaped opening in the center of the floor. The support member can be raised or lowered, for example, by means of a hydraulic cylinder 37.

Another feature which is preferably included in the apparatus is an air deflector 40 above the floor which directs the air flow created by the spinning rotor back toward the rotor. This prevents the rotor from throwing material upwardly and out of the tub.

The air deflector extends upwardly from the floor a few inches (e.g., about 4 inches) and projects horizontally over the rotor. Preferably the outer end 41 of the deflector projects downwardly slightly so as to direct the air flow downwardly toward the rotor. The outer end of the deflector could extend past the axis of the rotor if desired.

Another feature which can be included in the apparatus is an improved hammer design which is described in detail in my copending application Serial No. (Attorney Docket 52-04, filed of even date) which is incorporated herein by reference.

Other variants are possible without departing from the scope of this invention.

What is claimed is:

1. Tub grinding apparatus for grinding bulk materials, the apparatus being of the type including a rotatable tub having a stationary floor with an opening therein, and an elongated rotor member with radially extending hammer elements, wherein said rotor member is rotatably mounted in a manner such that the hammer elements extend at least partially through said opening in the floor and into the tub, wherein the improvement comprises comb means on said floor adjacent said opening and including a plurality of spaced-apart teeth members generally at a right angle to the longitudinal axis of the rotor member; wherein said comb means is movable relative to said rotor member in a manner such that the spacing between said comb means and said rotor member is adjustable; and further comprising a plurality of vertical bar members below said comb means and adjacent to said rotor member, wherein each said bar member includes a forward edge facing said rotor member; and wherein said forward edge includes notches.

2. The improvement in accordance with claim 1, wherein said comb means comprises a plate member having an upper surface to which are secured said teeth members.

3. The improvement in accordance with claim 2, wherein said teeth members are parallel to each other.

4. The improvement in accordance with claim 3, wherein said teeth members include forward and rearward ends, and wherein said teeth members slope upwardly from their rearward end to their forward end.

5. The improvement in accordance with claim 1, wherein said bar members are parallel to each other and are spaced at least about two inches apart.

6. The improvement in accordance with claim 1, wherein said vertical bar members are arranged in a first row, and further comprising a second row of notched vertical bar members below said first row; wherein the vertical bar members of said second row are horizontally offset relative to the vertical bar members of said first row.

7. The improvement in accordance with claim 1, further comprising an air deflector adjacent said opening for deflecting air flow from said rotor member downwardly toward said rotor member; wherein said air deflector extends substantially the full length of the rotor member.

8. The improvement in accordance with claim 7, wherein said air deflector includes a forward edge which extends past the axis of said rotor member.

9. The improvement in accordance with claim 1, further comprising restricter means below said floor and adjacent said rotor member; wherein said restricter means is curved; and wherein the spacing between said restricter means and said rotor member is adjustable.

10. The improvement in accordance with claim 9, wherein said restricter means comprises a plurality of horizontally disposed bar members held in spaced-apart curved raceways.

11. The improvement in accordance with claim 10, wherein said bar members can move angularly less than 10° relative to each other.

12. The improvement in accordance with claim 9, wherein said restricter means includes a lower end which is hingedly mounted below said rotor member.

* * * * *